United States Patent [19]

Essig

[11] Patent Number: 4,505,134

[45] Date of Patent: Mar. 19, 1985

[54] FLAT KNITTING MACHINE

[75] Inventor: Karl Essig, Gaienhofen, Fed. Rep. of Germany

[73] Assignee: H. Stoll GmbH & Co., Reutlingen, Fed. Rep. of Germany

[21] Appl. No.: 492,701

[22] Filed: May 9, 1983

[30] Foreign Application Priority Data

May 27, 1982 [DE] Fed. Rep. of Germany ..... 3219860

[51] Int. Cl.[3] ..... D04B 7/00; D04B 7/04

[52] U.S. Cl. ..... 66/60 R; 66/64

[58] Field of Search ..... 66/60 R, 62, 64, 69, 66/114, 126 R

[56] References Cited

U.S. PATENT DOCUMENTS 1,902,151 3/1933 Welch et al. ..... 66/60 R 4,339,933 7/1982 Inoue ..... 66/69

*Primary Examiner*—Ronald Feldbaum

*Attorney, Agent, or Firm*—Larson and Taylor

[57] ABSTRACT

A flat knitting machine, particularly one electronically operated and controlled and having two needle beds (17, 18), is provided with knitting assemblies (19–22) having cam parts for needle control, while the needle beds (17, 18) are mounted on the machine frame for reciprocating movement past the knitting assemblies. These can be coupled to a flat knitting machine which is provided with needle bed driving means, further flat knitting machines without an intrinsic drive, the needle beds of the latter being rigidly connected with the driven needle beds (17, 18) of the driven flat knitting machine (A). The flat knitting machine may be provided with a mechanism for adjusting the width of the comb gap and for each knitting assembly (19–21) with a special takedown mechanism (78–81) and with a thread change device (97–108).

20 Claims, 22 Drawing Figures

FLAT KNITTING MACHINE

Figure 3:
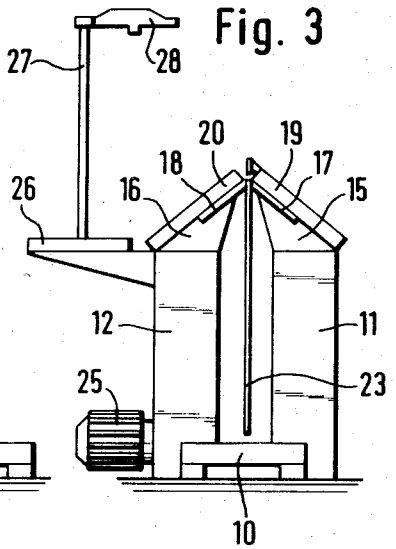

This invention relates to a flat knitting machine, and in particular an electronically controlled flat knitting machine, with two needle beds.

Hitherto known flat knitting machines are provided with stationary needle beds and have knitting assemblies thereof arranged on a movable carriage. With the introduction of electronic patterning means there has in flat knitting machines in practice been a shifting of the patterning mechanism from the stationary part of the machine containing the needle beds to the reciprocating carriage. As a result the carriages of the machines have become heavier and the use of trailing cables has been required to conduct electrical signals to the moving carriages. Also as a result of this development, besides the undoubted great advantage of the electronic machine control earlier latent mechanical problems have become sharpened, particularly in the making of shaped knitted products. Such problems are for example furnished by the thread feed which has to take place from one end of the flat knitting machine, with corresponding diversion of the yarn, because of the connecting arms of the carriage extending over the comb gap which exists in two-bed flat knitting machines. Further problems are involved in the take-down of the knitted fabric where a take-down mechanism has to be provided which is effective over the full length of the knitting machine.

It is an object of the present invention to so device a flat knitting machine, and in particular an electronically controlled and operated machine, in such a way as to provide a simple structure. The above object is met in the present invention by the fact that the needle bed or beds is or are mounted for movement in the longitudinal direction on the machine frame past at least one stationary knitting assembly having cam parts for controlling the needles. A plurality of knitting assemblies may be provided and each needle bed divided into a number of operating areas corresponding to the number of associated stationary knitting assemblies, these being separated by needle-free areas the length of which at least equals the length of the stationary assemblies.

This invention takes into account the change in the structure of flat knitting machines involved in the introduction of the electronic control insofar as the needle beds are now of less width and the knitting assemblies, which have become more complicated and elaborate, are now left stationary. Certainly free space must be left at the two ends of the flat knitting machine with the needle beds movable, but this is more than compensated by the advantages which are secured.

With the knitting assemblies made stationary with their cam parts for the movement of the needles and their control parts for needle selection, stitch length adjustment, etc., there is an elimination of the connecting arms between the knitting assemblies bridging the comb gap between the needle beds, so that the threads can be fed directly to the knitting assemblies. The multiplicity of thread guide arrangement with thread guide casings and cover rails are dispensed with. There is no need any longer for trailing cables because the electronic connections are disposed fixedly on the machine frame can be taken directly to the knitting assemblies. Also the lateral abutment casings of conventional machines are eliminated.

The movable needle beds can be more safely disposed on stationary supports which, at least at the knitting assembly areas, can advantageously be connected to the machine frame through vertical columns having a foot portion. In the absence of bridges between the front and the rear needle beds the needle bed supports can advantageously be adjustable transversely to the direction of travel of the needle beds so that, in a flat knitting machine made in accordance with this invention, an adjustment of the comb gap between the needle beds can be implemented for the benefit of the knitted fabric. This enables the fabric to be of greater or less bulk.

There is no problem in driving the needle beds by means of a controlled reversing motor, in which event advantageously each of the two needle beds is coupled thereto by an endless driving belt arranged in the associated needle bed support and conducted downwards over a drive wheel. The drive wheels of the two driving belts may be secured to a common drive shaft arranged in the lower part of the machine frame and coupled to the controlling reversing motor. Racking of the needle beds can be performed during the movement of the needle beds, a simultaneous racking of the front and rear needle beds being possible and thus large racking variations performed in a very short time. The racking can advantageously be effected by arranging that the direct pulleys for the needle bed drive belts provided in the area of a vertical column be mounted on a carriage which is displaceable in the direction of movement of the needle bed on the machine frame, and this coupled through an adjusting spindle with an electrical stepping motor. Each needle bed may however be connected to the common reversing motor through a planetary gear, a racking of the needle bed being performed by an adjustment of this gear. Advantageously the individual racked positions of the needle beds can be determined by stops in the needle-free zone of the needle beds, for example by abutment slides which can be adjusted during the passage of the needle beds through a knitting assembly by buffer members disposed there.

A great advantage of a flat knitting machine construction in accordance with the invention resides in the fact that during the making of shaped knitted products the needle beds do not always have to carry out their full travel. It is possible that in a narrowing operation, during the passage of the needle beds beneath a knitting assembly, for example in the case of a left to right direction of needle bed travel, first the right and left knitted edge will be transferred to the rear, and then during the next following needle bed movement to the left the stitches in the needles of the rear needle bed, which are to be narrowed, before reaching the transfer cam parts, will be racked to the right through a predetermined number of needle divisions depending on the required amount of narrowing. Immediately after these lefthand edge stitches have been transferred to the front, the rear needle bed can be adjusted to the left through a required size of needle division—all this during the movement of the needle beds—and during further common movements of the needle beds to the left the needles having thereon the righthand needle stitches come into the vicinity of the transfer cam parts of the stationary knitting assembly and are transferred back into the front needle bed. This means that the complete narrowing procedure of the righthand and the lefthand edge of the fabric can be carried out during a single reciprocation of the needle beds. In the case of a conventional flat knitting machine the carriage has to make a double reciprocating movement for this purpose. In the case of asymmetric narrowing it is sufficient for the needle beds only to reciprocate over a length equal to the length of the knitted edge to be narrowed under the knitting assembly provided with transfer cam parts.

The stationary knitting assemblies can be readily exchanged and replaced by knitting assemblies having a different cam structure. Advantageously the lock plate with the cam parts, the needle changing elements and all the associated adjusting and control parts can be arranged at each knitting assembly in a housing or frame which can be snapped on the needle bed support for changing parts of the needle bed or removed for complete replacement.

Since the places at which the stitches are formed are fixed in the machine it is not only possible to provide a direct feed of at least one thread from a stationary bobbin table through the usual thread brake and thread monitor to the knitting assembly, but there is an advantageous facility for using thread change devices. Thus with a flat knitting machine equipped in accordance with the present invention each stationary knitting assembly can be arranged with a thread change device to which a plurality of threads can be fed simultaneously and directly from the bobbin table through thread tensioning and monitoring member. There can be associated with each knitting assembly advantageously of double cambox type, a thread guide bracket in which a pre-selectable thread guide can be inserted from a magazine, movable with the needle bed, and applied between the two clearing cambox parts of the double cambox knitting assembly. The magazine advantageously can be displaceably mounted on a rail which is connected to the movable needle bed and be operated by a stationary, controllably-operable abutment pin.

The stationary stitch forming areas in a flat knitting machine constructed in accordance with this invention provide the further advantage that the fabric take-down can be restricted to these areas. Thus it is not required to have a fabric take-down device which is effective over the complete length of the machine as is the case with conventional flat knitting machines. Thus two opposed rotary bodies advantageously can be provided as take-down bodies at the individual knitting zone, and arranged beneath a sliding part of the knitting assembly and operated in dependence on the passing movement of the needle beds, the knitted fabric moving with the needle beds being passed between these bodies. By setting the inclination of travel of the knitted fabric from an exact transverse position to either side the take-down pull component can be continuously adjusted from a zero value to a maximum suited to the type of fabric, the quality of the thread, and so on. This adjustment can likewise take place during the movement of the needle beds. When there is a reversal of the needle beds the take-down members can be brought into a different take-down position and the direction of rotation of the take-down members can be varied. By varying the rate of rotation of the rotary bodies serving as the take-down members, and thus their peripheral speed relatively to the speed of travel of the needle beds, not only can the required take-down effect be produced but also a corresponding spreader effect on the knitted edge. By this means the transfer of the stitches is greatly facilitated during the narrowing because the take-down members guarantee that the stitches are transferred upright and not obliquely into the needle hooks and as a consequence can slide readily over the backs of the needles. These possibilities of variation in toto reduce the take-down stress applied to the knitted fabric at the knitting assemblies in comparison with usual machines, so that there is no danger of over-tensioning of the stitches by the take-down mechanism. In the case of three-dimensional knitted fabrics, for example in the making of brassieres, with a flat knitting machine constructed in accordance with the present invention it is possible for a take-down action to be exerted by the take-down mechanism in the area only of the stitches to be sunk, whilst during the passage of nonactive needles the take-down mechanism can be brought into a position exactly transverse to the direction of passage, in which no stress is applied in the take-down direction.

A very important advantage of the flat knitting machine conforming with the present invention is that without difficulty whole machine groups can be formed which can be simultaneously controlled from a single computer. These machine groups can be segregated into parent machines and subsidiary machines, with only the parent machine provided with a driving means and needle bed racking devices, whilst the subsidiary machines can move with the parent machine by virtue of a rigid coupling between their respective needle beds. This facility for coupling the flat knitting machines in itself greatly decreases the drawback, referred to above, of having to provide for free spaces at the ends of the machines.

Hereafter an embodiment of a flat knitting machine incorporating the features of the invention will now be described with reference to the accompanying drawings.

Figure 1:
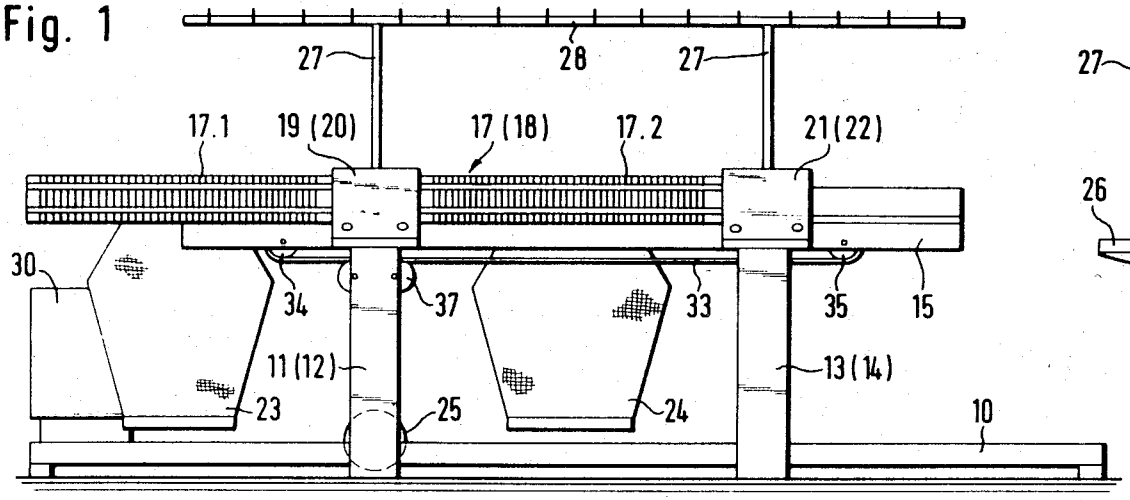
Figure 2:
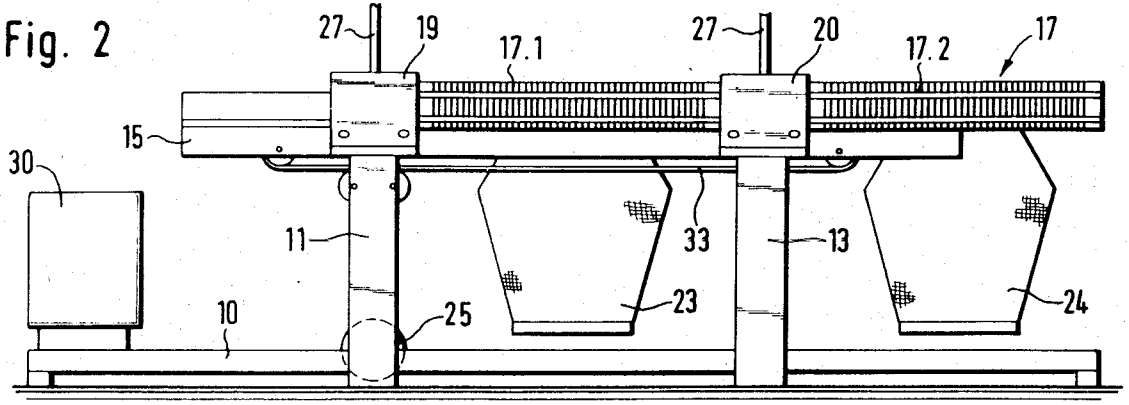
Figure 4:
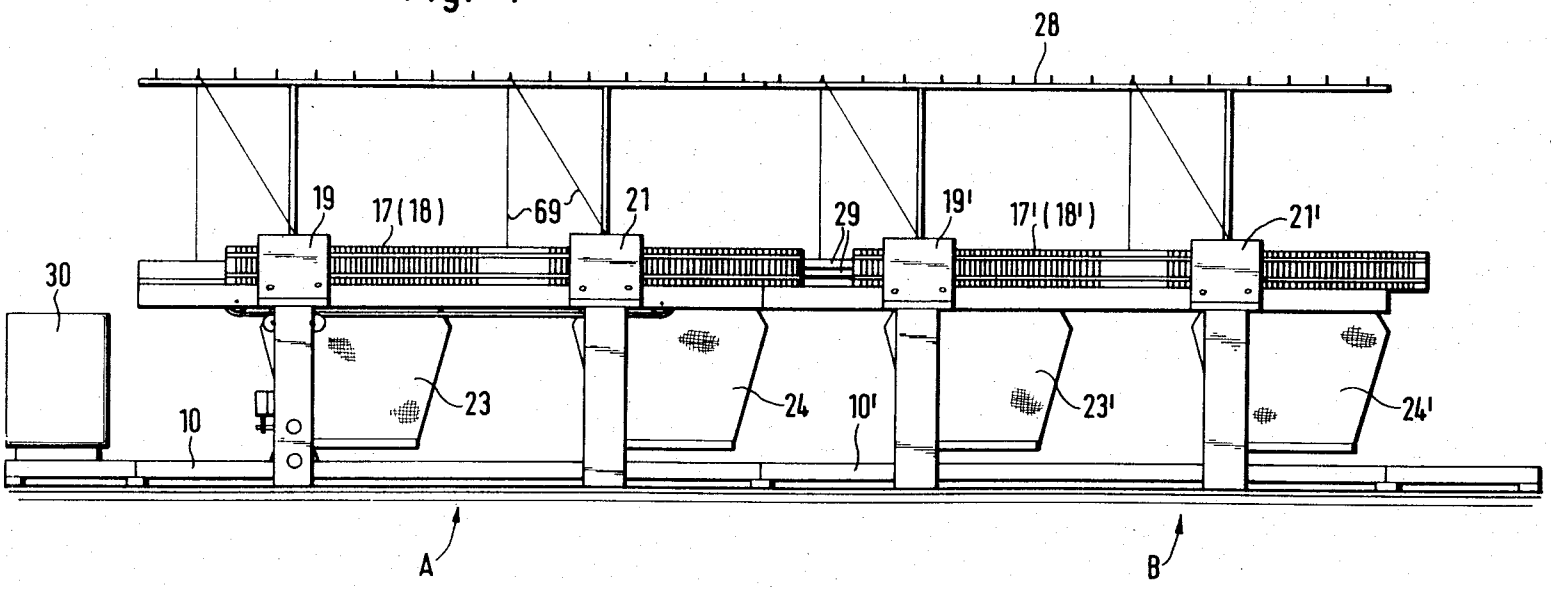
Figure 5:
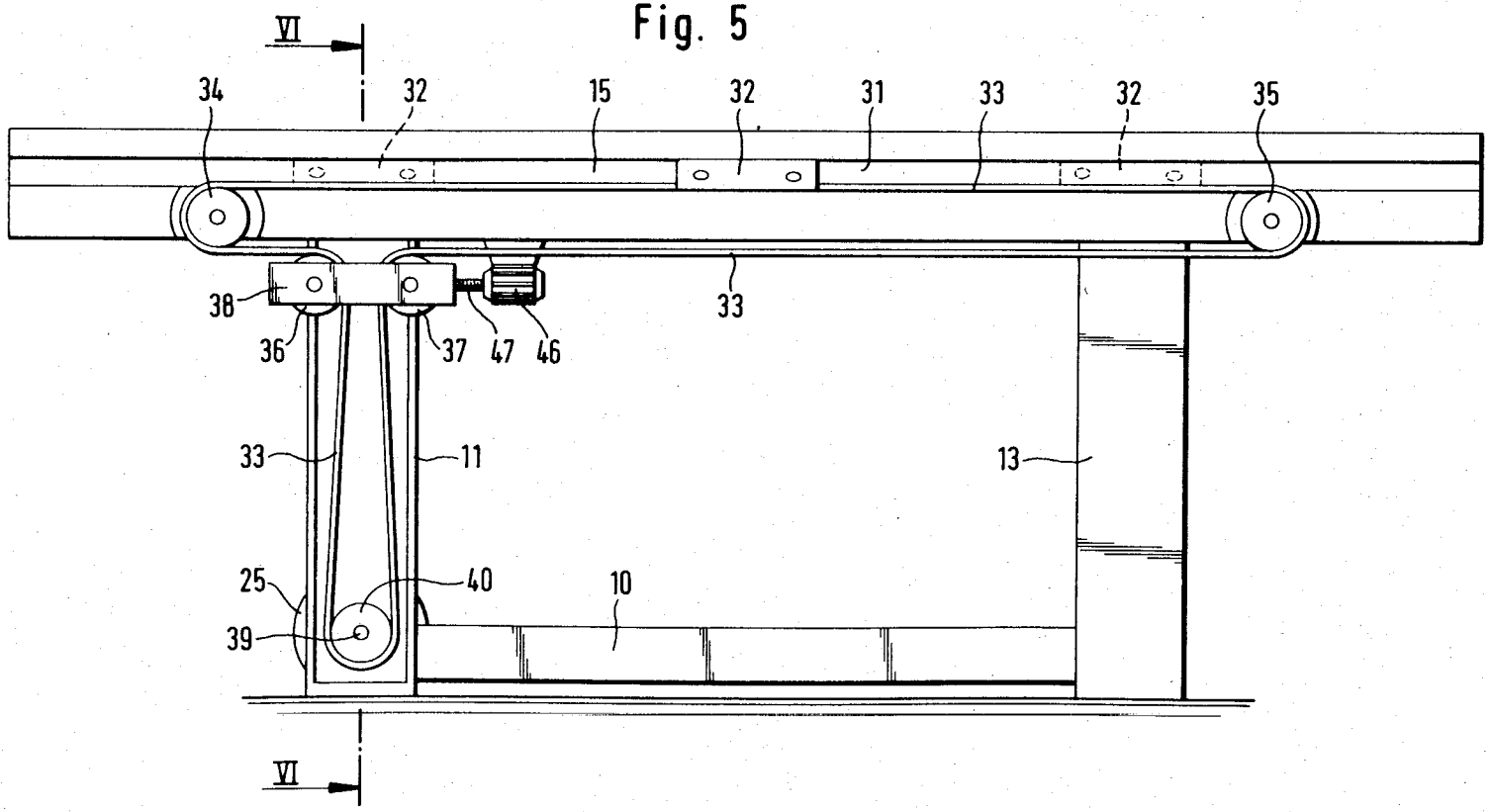
Figure 7:
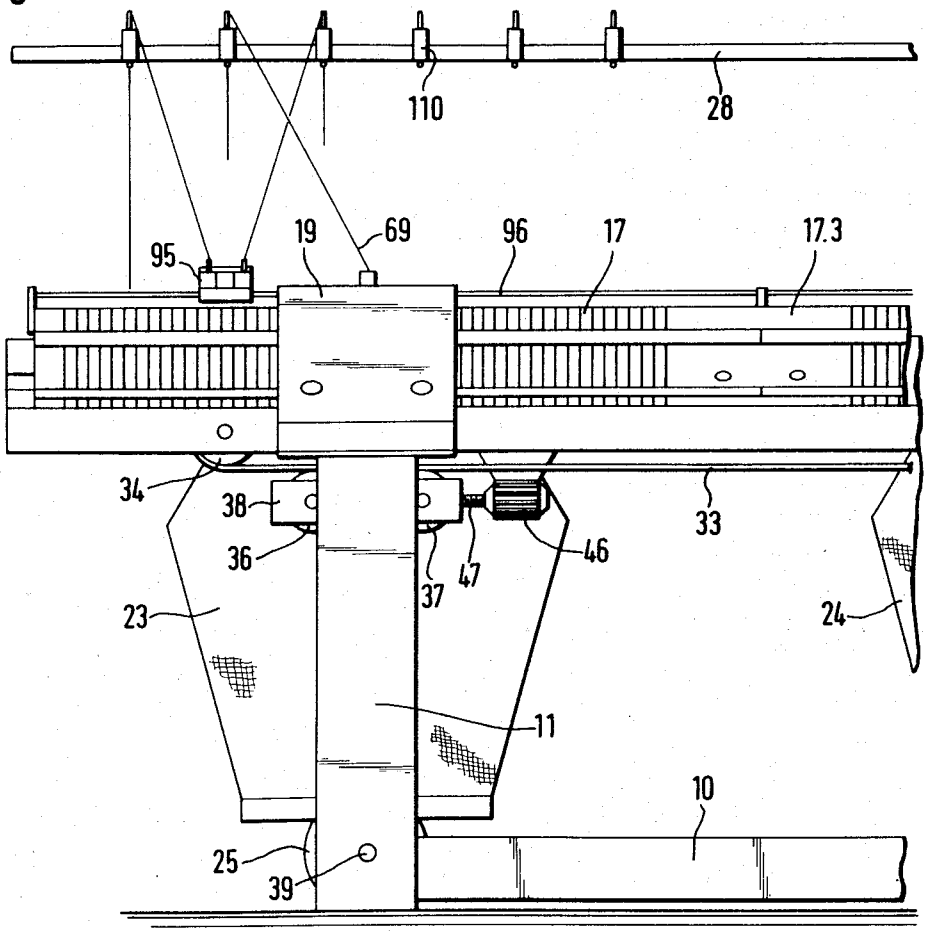
Figure 6:
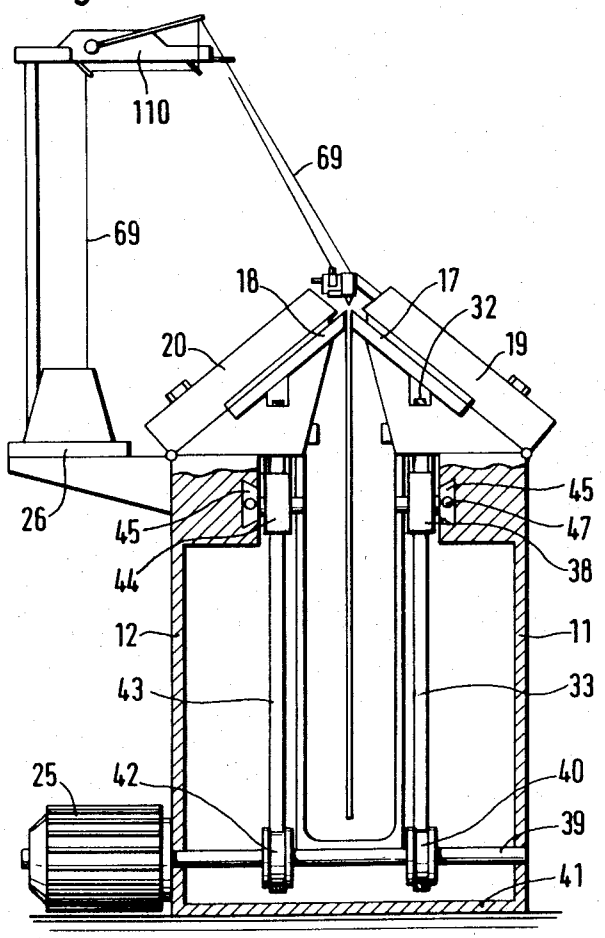
Figure 9:
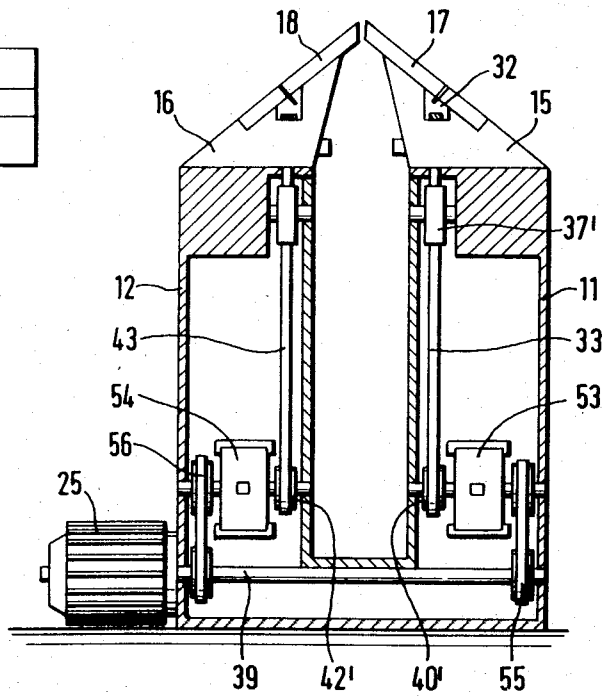
Figure 8:
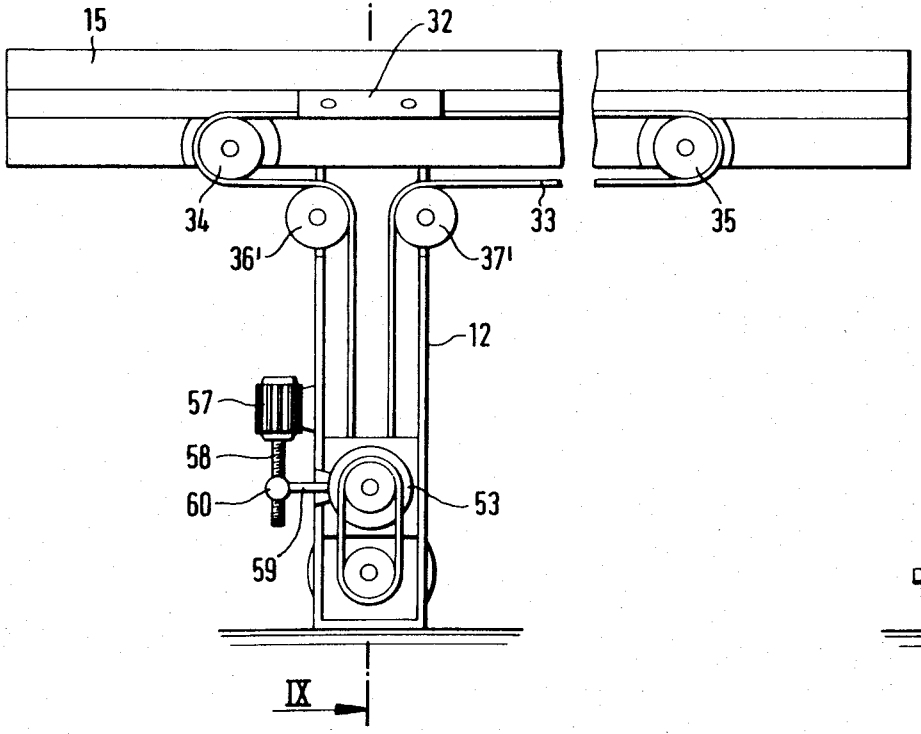
Figure 11:
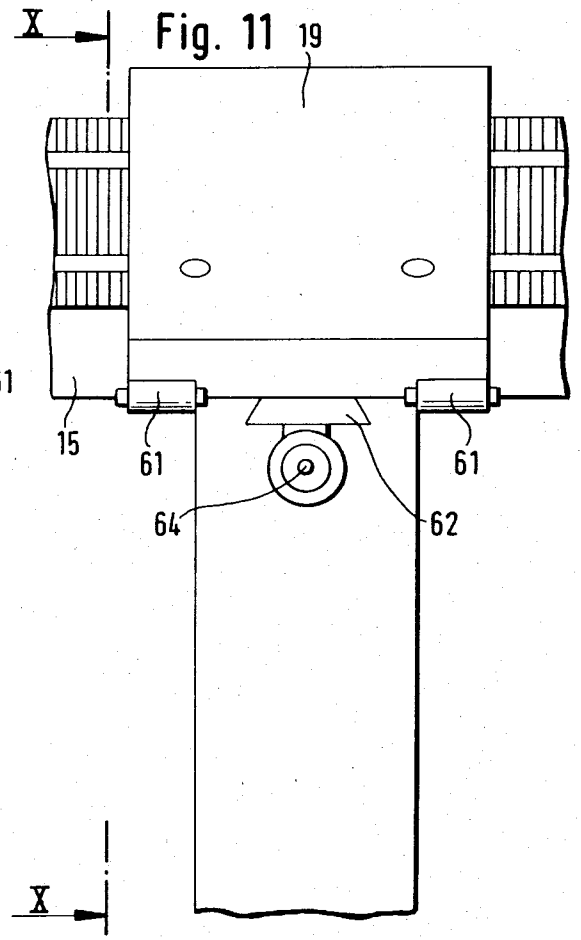
Figure 10:
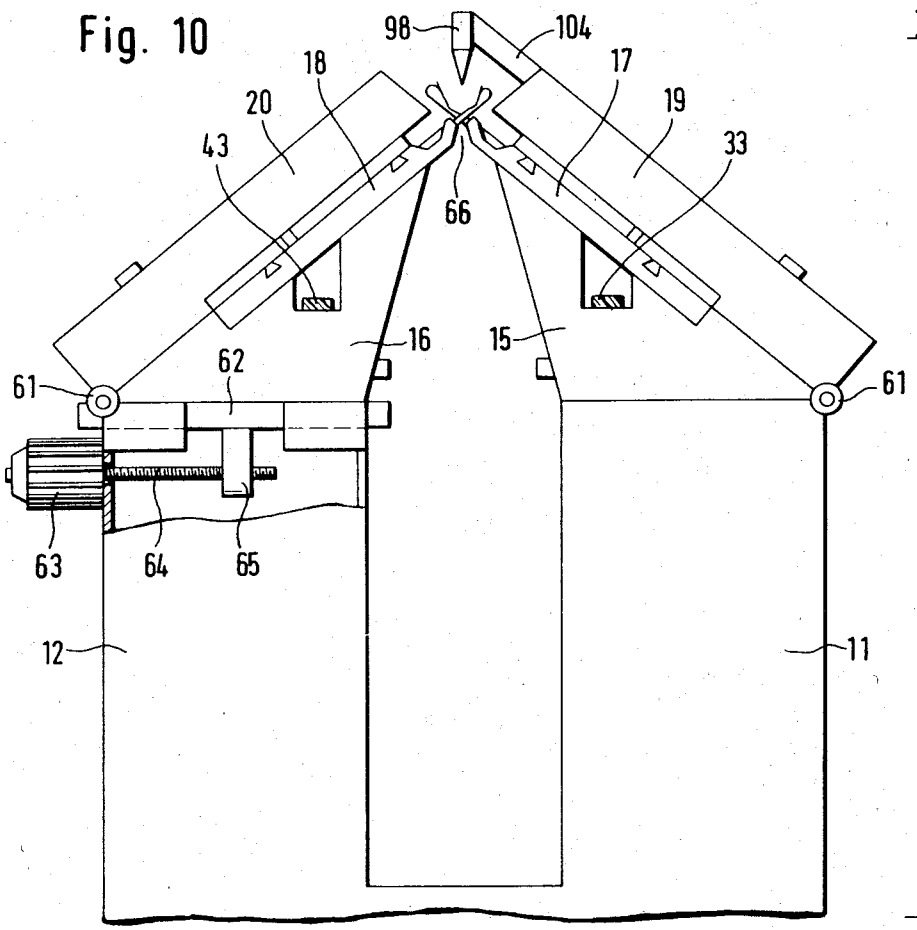
Figure 12:
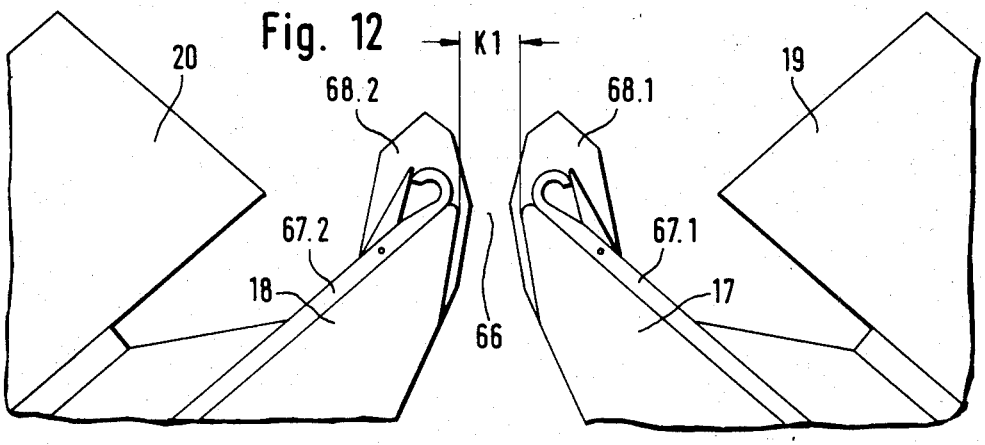

In the drawing;

FIG. 1 is a diagrammatic side view of a flat knitting machine with the needle beds in their lefthand end position, FIG. 2 is a side view similar to that of FIG. 1 showing the needle beds in their righthand end position, FIG. 3 is a diagrammatic end view of the flat knitting machine, FIG. 4 is a side view of a parent machine coupled with a slave machine, FIG. 5 a diagrammatic illustration of the means for driving a needle bed of the flat knitting machine with a first embodiment of a racking arrangement, FIG. 6 a cross section through the flat knitting machine on the line VI—VI of FIG. 5, FIG. 7 is a partial view of the flat knitting machine showing a knitting assembly incorporating a thread change device, FIG. 8 is a diagrammatic illustration of the driving means of the machine with a second embodiment of a racking mechanism, FIG. 9 a cross section through the flat knitting machine of FIG. 8 taken on the line IX—IX of FIG. 8, FIG. 10 a diagrammatic cross section through an embodiment of the flat knitting machine on the line X—X of FIG. 11 showing a device for varying the comb width, FIG. 11 a side view of a knitting assembly of a flat knitting machine in accordance with FIG. 10, FIG. 12 an enlarged partial sectional illustration of the flat knitting machine according to FIGS. 10 and 11 in the area of the comb gap where this gap is narrowed.

Figure 13:
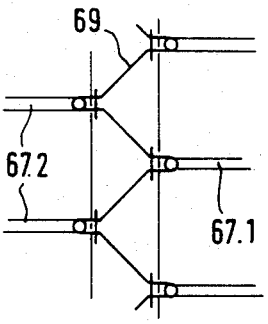
Figure 14:
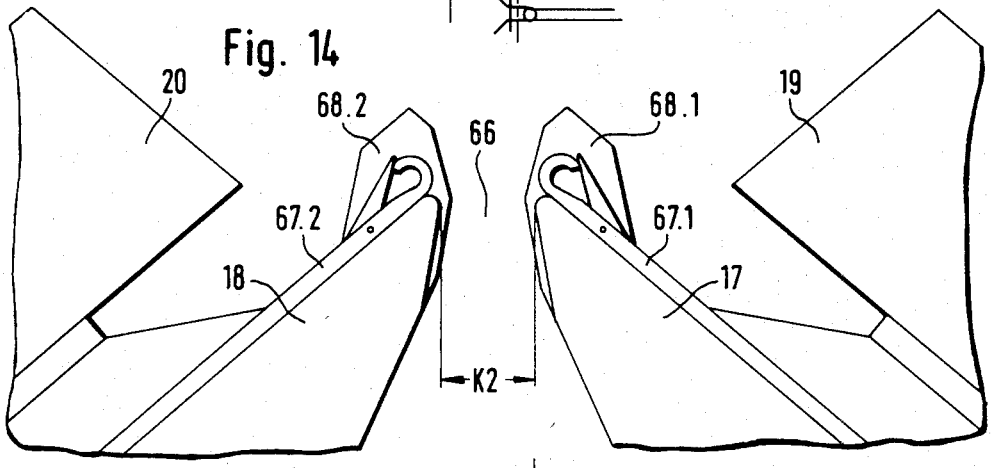
Figure 15:
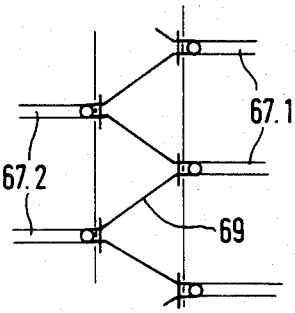
Figure 16:
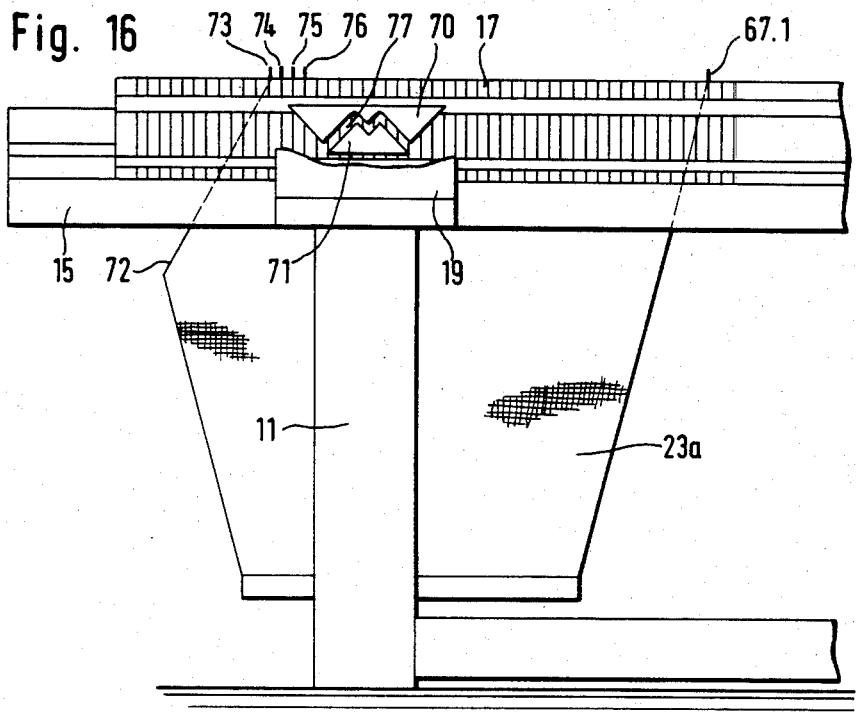
Figure 17:
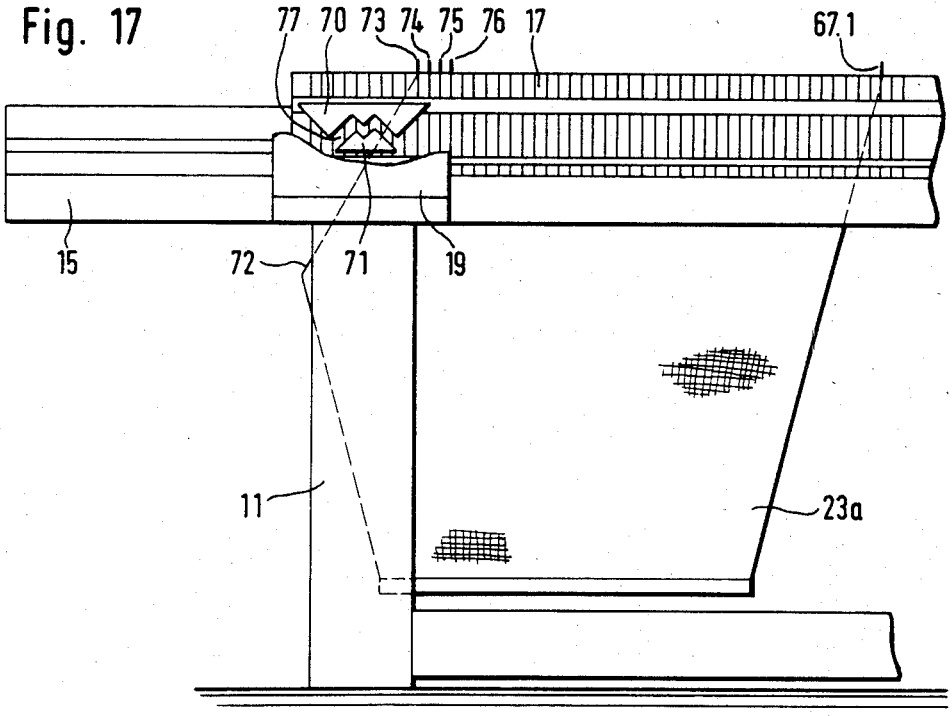
Figure 18:
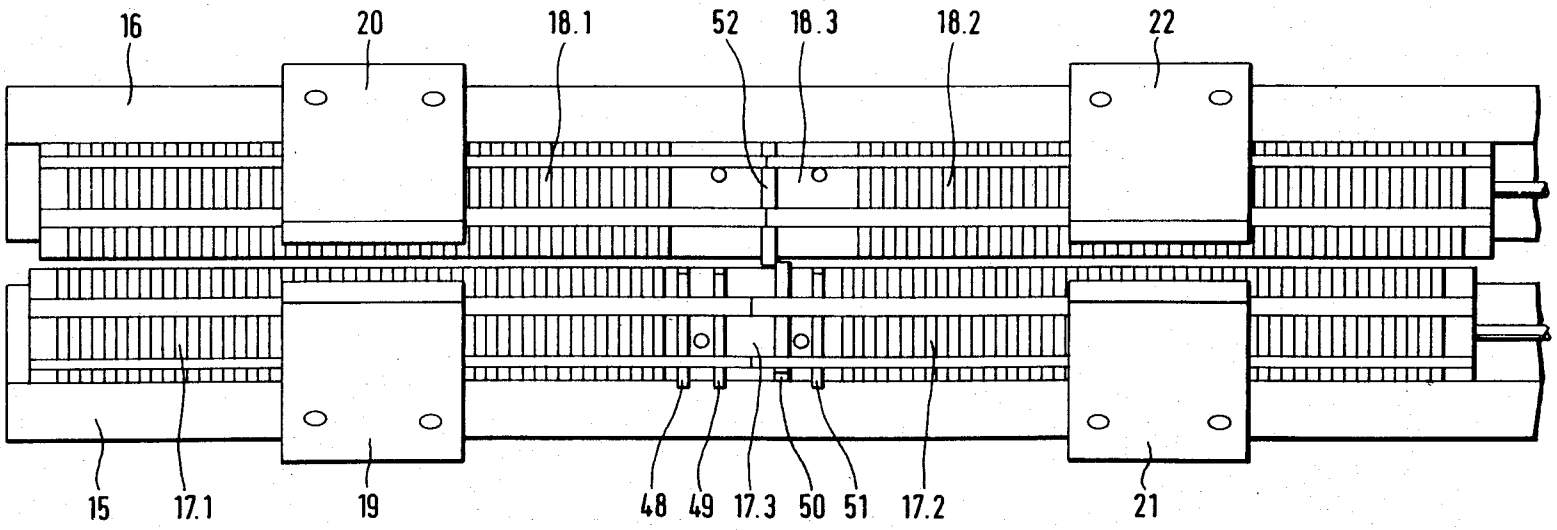
Figure 20:
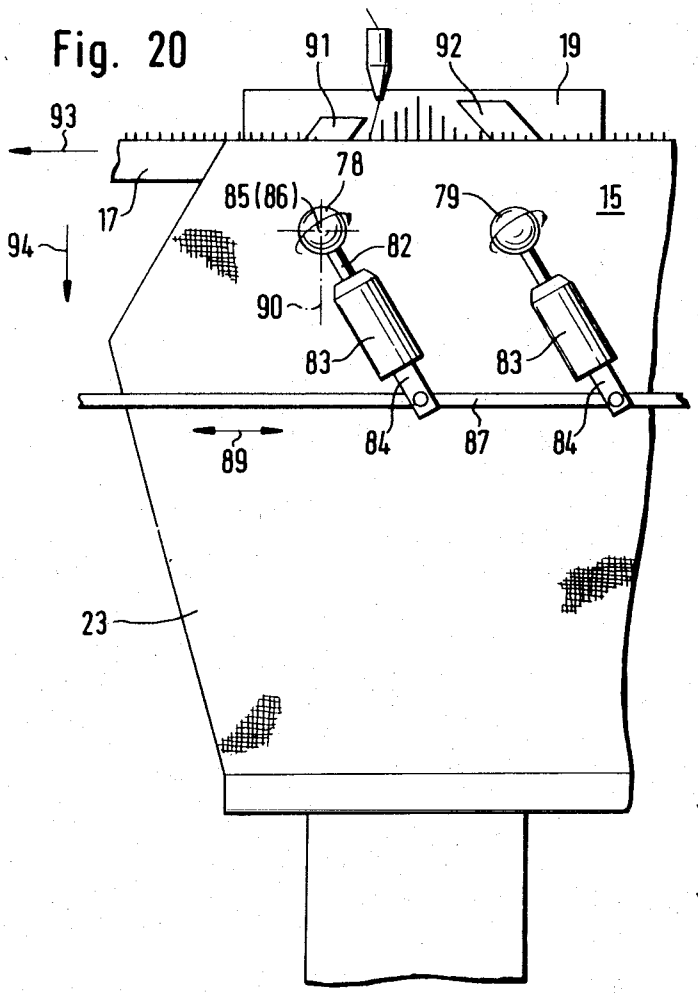
Figure 19:
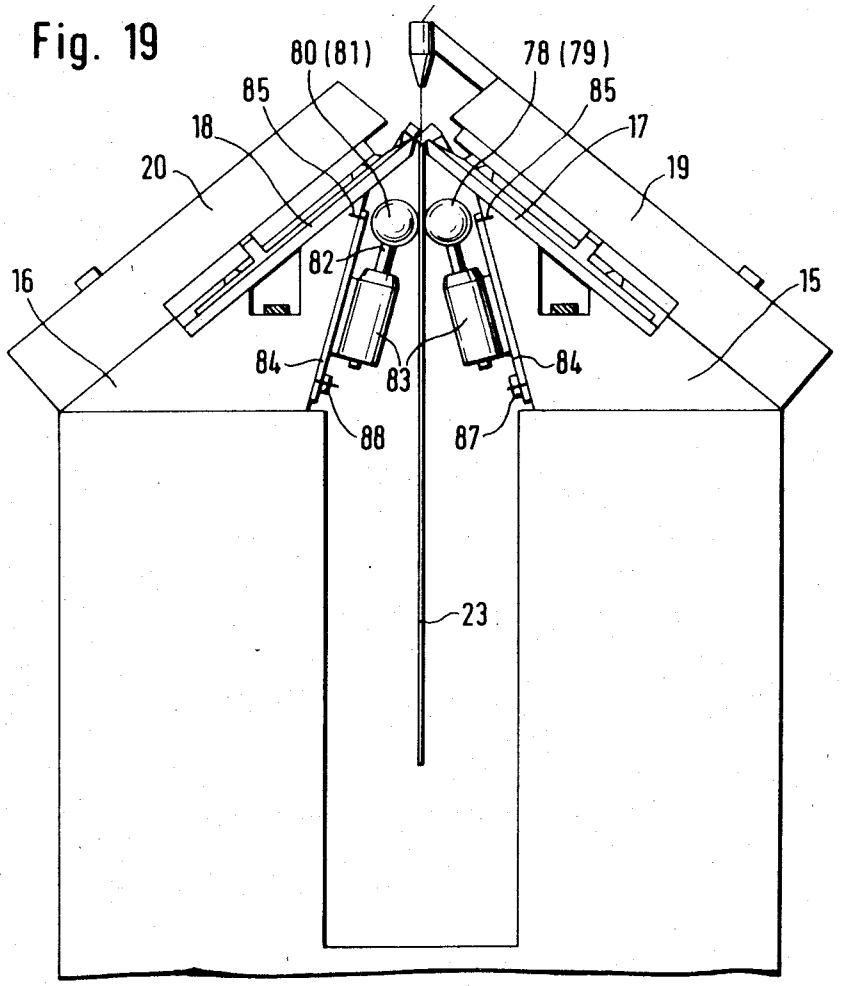
Figure 21:
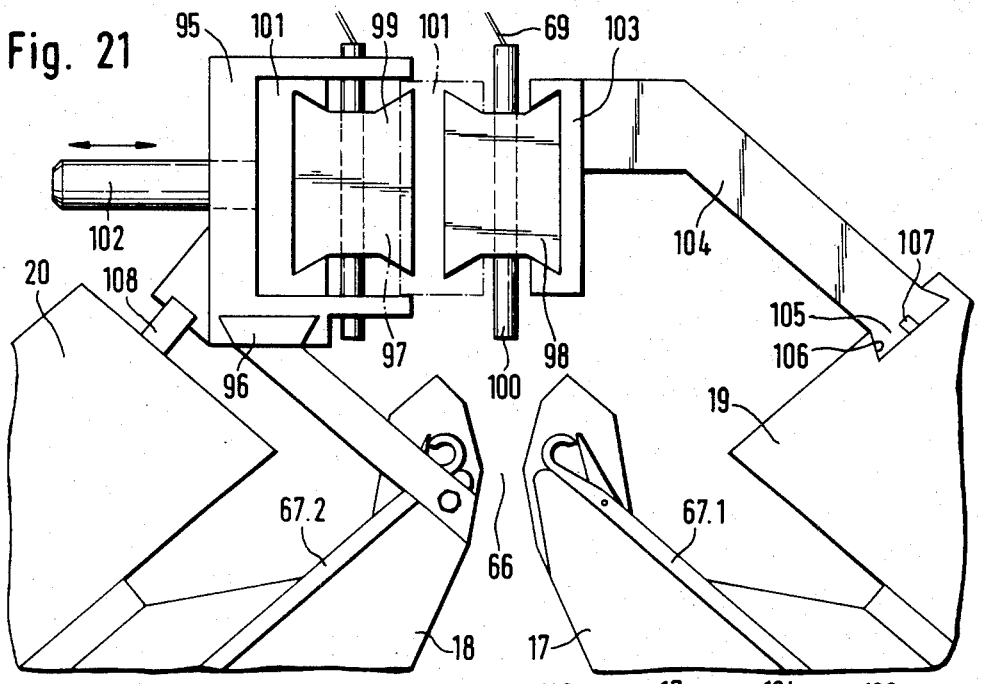
Figure 22:
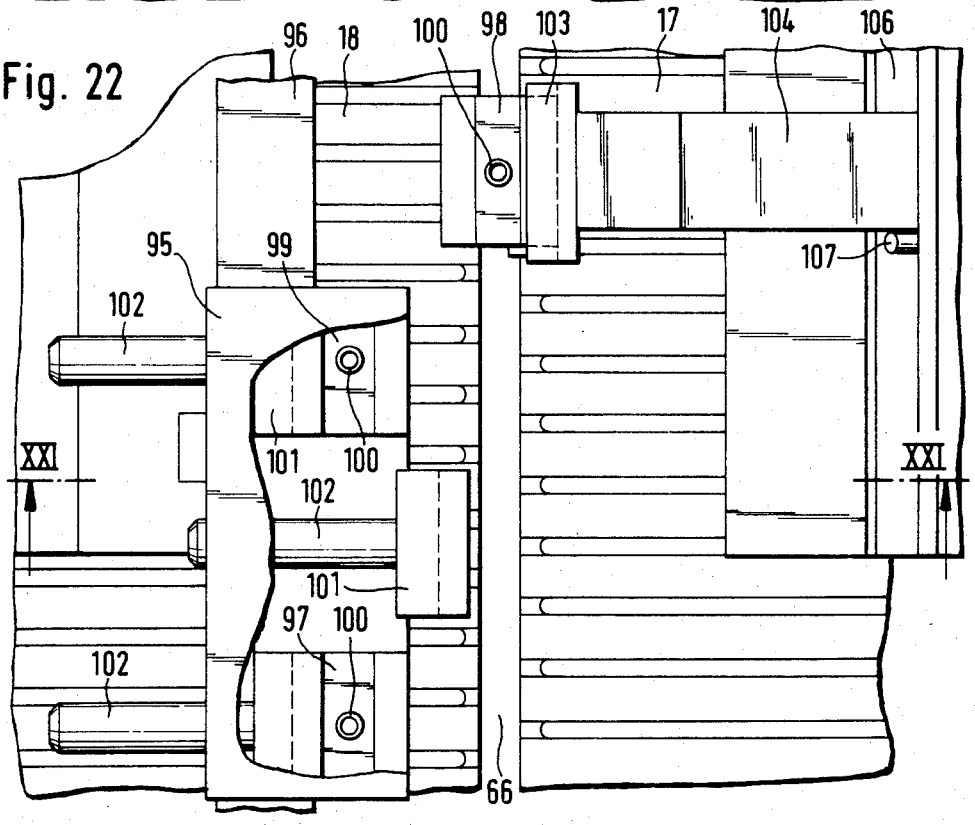

FIG. 13 an illustration of the stitching during knitting with the comb gap set in accordance with FIG. 12, FIG. 14 is an illustration corresponding to that of FIG. 12, with the comb gap widened, FIG. 15 illustrates the thread layout during knitting with the comb gap widened, in accordance with FIG. 14, FIGS. 16 and 17 two diagrammatic illustrations of differend needle bed positions during asymmetric narrowing of a shaped knitted product, FIG. 18 a diagrammatic plan of two oppositely racked needle beds of a flat knitting machine showing abutments for determining the differing racked positions, FIG. 19 a diagrammatic end view of a flat knitting machine having a takedown mechanism, FIG. 20 a diagrammatic side view of the take-down mechanism associated with one knitting assembly of the flat knitting machine, FIG. 21 a diagrammatic cross section through a knitting assembly incorporating a thread change device, taken on the line XXI—XXI of FIG. 22, FIG. 22 a plan view of the thread change device of the knitting assembly shown in FIG. 21.

FIGS. 1 to 3 illustrate the foot part 10 of the flat knitting machine in the form of a product collecting device from which support columns 11, 12 and 13, 14 upstand in vertical pairs and carry the two needle bed supports 15 and 16. Mounted on these are the needle beds 17 and 18 of the V-bed machine illustrated which are provided with needle tricks in the usual way and are longitudinally movable. Both needle beds 17, 18 are sub-divided into two halves 17.1 and 17.2 associated with each of which is a knitting assembly 19 and 21, and 20 and 22, respectively having a double cam system and being stationarily arranged in the area of support columns 11, 12, 13 and 14. Each knitting assembly comprises the cam parts and the control means which, in customary electronically controlled flat knitting machines, are provided on the carriages and in the stitch boxes at the end of the needle beds which in those cases are stationary. The construction and layout of these individual parts of the knitting assemblies are of no interest to the present invention.

In the flat knitting machine illustrated a shaped knitted product 23 or 24 is formed on each needle bed half 17.1, 17.2 and the non-visible halves of the other needle bed 18, this product being reciprocated with the needle beds 17 and 18. These two needle beds 17 and 18 are operated by means of a controlled electrical reversing motor 25. The construction of the driving means is described in more detail in reference to FIGS. 5 to 7.

Also illustrated in FIGS. 1 to 3 is a stationary bobbin table 26 over which is arranged on supports 27 a common control plate carrying thread braking means and thread monitors not shown in detail (110, FIG. 6). FIG. 1 shows the needle beds 17, 18 in their lefthand end position, and FIG. 2 shows them in their righthand end position.

FIG. 4 illustrates the flat knitting machine of FIGS. 1 to 3 as comprising a parent machine A and a slave machine B. The slave machine B has the same construction of machine frame, needle beds, and knitting assemblies as the parent machine A, and like parts of the slave machine are indicated by the same reference numerals but with an added priming mark.

The two flat knitting machines A and B are so arranged side by side that their needle beds 17, 17′ and 18, 18′ are flush with one another and the needle beds 17′, 18′ of the slave machine B are rigidly connected to the needle beds 17 and 18 of the parent machine A by coupling bars 29. Thus the slave machine B is driven from the parent machine A and does not require any individual driving means. The knitting assemblies 19, 21, 19′ 21′ of the two machines A, B are controlled from a common computer 30. If the driving means of the parent machine A is made sufficiently big further slave machines B can be attached to the parent machine A.

FIGS. 5 to 7 show the means for driving the flat knitting machine including a first embodiment of a device for racking the needle beds. In FIG. 5 the front needle bed 17 is removed and only the needle bed support 15 is visible. The needle bed support 15 has over its full length a continuous guide groove 13 for a slide 32 detachably connected to which is the needle bed 14 which is not here shown. The slide 32 is shown in full line in its middle position and in dotted lines in its lefthand and its righthand end positions.

The slide 32 is connected to a driving belt 33, preferably of toothed type, which runs over divert pulleys 34 and 35 disposed at the end areas of the needle bed support 15 and over two divert pulleys 36 and 37 mounted on a bracket 38 adjustable on the support columns 11. The driving belt 33 on the support columns 11 is guided downwards over the two pulleys 36 and 37 of the bracket 38 to a driving wheel 40, which is mounted in the bottom part 10 of the flat knitting machine and is secured to the driving shaft 39 connected to the common reversing motor 25. As shown by FIG. 6, in the illustrated embodiment of the flat knitting machine the two support columns 11 and 12 are connected by a foot portion 41 to form a common U-shaped support body in the bottom part 41 of which is mounted the driving shaft 39 to which, in addition to the driving wheel 40 for the driving belt 33 for the needle bed 17, the driving wheel 42 for the driving belt 43 for the rear needle bed 18 is also secured. The driving belt 43 is guided, in exactly the same way as the driving belt 33, over divert pulleys and a movable bracket 44. FIG. 6 shows that the brackets 38 and 44 are provided with a dovetail guide 45. By adjusting the bracket 38 or 44 by means of a stepping motor 46 with a threaded spindle 47 a needle bed racking is produced for the needle bed 17 or 18 which is coupled with the driving belt 33 or 43 concerned.

If for example the bracket 38 with its divert pulleys 36 and 37 is shifted to the left in FIGS. 5 and 7 through a one division step of the needle bed, the slide 32 and with it the central part 17.3 of the needle bed 17 (free of needle tricks) connected thereto undergoes a corresponding racked movement to the right. The bracket 44 with the divert pulleys for driving belt 43 of the rear needle bed 18 can be shifted to the right simultaneously and during the needle bed movement, for example through two half-division steps, so as to produce a corresponding shifting of the rear needle bed 18 to the left and bring about an overall racking of the two needle beds of three half needle steps.

In order to accurately set the individual racked positions of the needle beds, in accordance with FIG. 18 a plurality of slidable abutments 48, 49, 50, 51 are arranged in the central section 17.3 of the front needle bed 17, which section is free of needle tricks, and a counter abutment 52 arranged in the needle trick free central part 18.3 of the rear needle bed 18. All these abutments 48–52 can be shifted in the knitting zone 19–22 of the flat knitting machine from a rest position into a stop position, and vice versa.

In FIG. 18 the abutsments 50 and the counter abutments 52 are shown in their operative positions. When these abutments meet the front needle bed 17 has been racked through one needle division to the left relatively to the rear needle bed 18. The racking movement is effected by an adjustment of the bracket 38 to the right in FIG. 5 or 7. Advantageously the racking travel of the bracket 38 is somewhat larger than the required racking travel. By this means the abutment 50 is applied under stress against the counter abutment 52 of the rear needle bed 18. This stress compensates for any play in the operating means of the needle bed and other possible tolerances. All the potential racked positions of the two needle beds 17, 18 can be accurately set by a combination of the counter abutments 52 with the other abutments 48, 49 and 51.

FIGS. 8 and 9 illustrate a second embodiment of the racking means. Here the driving belts 33 and 43 for the two needle beds 17, 18 are conducted downwards in each case over common adjustable divert pulleys 36' and 37' in the support columns 11, 12 to a driving wheel 40' or 42'. These wheels 40' and 42' are seated on the driving shaft of a planetary gear in a housing 53 or 54. The driving shafts of the two planetary gears are driven through driving belts 55 and 56 from the common shaft 39 of the reversing motor 25. The housings 53, 54 of the planetary gears are of circular form and rotatably mounted. An adjusting movement of the housing 53 or 54 is performed by means of a control stepping motor 57 with a threaded spindle 58 which coacts with a nut 60 arranged at the end of a lever 59 connected to the gear housing. A racking movement of the front needle bed 17 is achieved by a prescribed rotation of the housing 53 of the planetary gear associated with this needle bed 17. At the same time an opposite racking movement of the rear needle bed 18 can be effected by a rotation of the housing 54 of the other planetary gear.

FIGS. 10 and 11 show an embodiment of the flat knitting machine in which the individual knitting assemblies, for example in this case the assemblies 19 and 20, can be swung up through links 60, 61 and interchangeably arranged on the needle bed supports 15 or 16. Thus for example in the case of a two-colour knitted pattern a knitting assembly with a double cam box can be inserted without any transfer cams, whilst when knitting of a transfer pattern is required a knitting assembly, for example having a single cambox and a transfer cam system, can be applied. The two needle supports 15 and 16 of this flat knitting machine are in each case mounted through a dovetail guide part 62 in the support columns 11 and 12 so as to be displaceable transversely to the longitudinal direction. The transverse shifting of the needle bed supports 15 and 16 is performed by adjusting motors 63 with threaded spindles 64, one of which is illustrated in FIG. 10. The adjusting motors 63 are secured to the support column 11 or 12 and the threaded spindles 64 thereof cooperate with a threaded nut 65 which is secured to the dovetail guide part 62. Thus the width of the comb gap 26 between the two needle beds 17 and 18 can be adjusted by means of the setting motors 63. The implementation of the adjustment in width of the adjustment in width of the comb gap 66 is explained below with reference to FIGS. 12–15.

FIG. 12 shows the two needle beds 17 and 18 in the position in which the comb gap defined between them has a minimum width $K_1$. FIG. 14 shows the two needle beds 17 and 18 with their needles 67.1 and 67.2 and the knockdown bars 68.1 and 68.2 in a relative position in which they define a maximum comb gap width $K_2$. FIG. 13 shows the travel of a thread 69 between the needles 67.1 and 67.2 in the case of a comb gap width $K_1$ and FIG. 15 the travel of the thread 69 in the case of a comb gap width $K_2$. Comparison of the two FIGS. 13 and 15 clearly shows the maximum thread length defined between the needle 67.1 of the front needle beds 17 and the needles 67.2 of the rear needle bed 18 when the setting is at the maximum width of a comb gap 66 a more bulky knitted product is produced in comparison with that from the narrower comb gap width $K_1$.

As has already been stated in the case of a flat knitting machine constructed in accordance with the present invention there does not necessarily have to be a travel of the needle beds 17 or 18 over the complete width of the knitted product in performance of narrowing. FIGS. 16 and 17 show that in the case of asymmetric narrowing one needle bed 17 need only travel though one knitting assembly 19 over the range of the edge of the product which is to be narrowed. The transfer cam parts 70 and 71 of the assembly 19 are shown in FIGS. 16 and 17. The asymmetric knitted parts **23*a* is suspended from the needles 73–76 at the lefthand edge 72 to be narrowed and are intended to receive an edge for example of four-needle width. After knitting one stitch course the needle bed 17 is in the position seen in FIG. 17 in which the needle 73 has passed through the knitting assembly 19. In this reversing position of the needle bed 17 a racking of the needle beds into the required transfer racking position is performed, as a result of which the needle bed 17 is adjusted to the left. The needles 73–76 are selected by the electronic needle selection means (not shown) and pass through the cambox channel 77 of the transfer cam parts 70, 71. When the needle 76 has passed through this cambox channel 77 and the needle bed 17 has reached the positon shown in FIG. 16 the transfer of the marginal stitches to the rear needle bed 18 takes place. The movement of the needle bed 17 is now reversed and the needle beds 17, 18 are moved into a new transfer racking position. During the needle bed movement to the right the needles 76, 75, 74 and 73 pass through the correspondingly indexed transfer cam parts 70, 71 until the needle bed 19 has returned to the position illustrated in FIG. 17. The lefthand edge 72 of the fabric is then reduced and knitting can be continued again over the complete working range of the needles, that is to say up to the needles 67.1 indicated. The needle 73** now holds no stitch as a consequence of the narrowing process and is out of action.

FIGS. 19 and 20 show the fabric take-down mechanism associated with one pair of knitting assemblies 19/20, assuming a cambox with two adjacent knitting systems. This take-down mechanism comprises two spherical take-down members, respectively 78 and 79 and 80, 81, on each of the needle bed supports 15 and 16. Both spherical take-down members 78, 79 on one needle bed support 15 cooperate pairwise with the two spherical take-down elements 80, 81 of the other needle bed support 16. As shown by FIG. 19 the take-down members 78 and 80 and 79 and 81 are located opposte one another and the knitted fabric 23 made at the knitting assemblies 19, 20 pass between the roller pairs. The spherical take-down members 78–81 is, in each case, mounted on the shaft 82 of the electric driving motor 83. All the driving motors 83 turn at a speed tuned to the operating movement of the needle beds 17, 18. Instead of using these electric motors 83 there can be a mechanical drive connection between the take-down members 78–81 and the needle beds 17, 18 or the means for driving the same.

All the driving motors 82 with the spherical take-down members 78–81 are secured to a bracket 84 which is pivotally mounted on a spindle 85 on the needle bed support 15 or 16, this passing through the centre 86 (FIG. 20) of the take-down member. At one end the brackets 84 are pivotally connected to a change-over bar 87 or 88 movable in the longitudinal direction of the needle bed support 15 or 16. These change-over bars 87 and 88 can be moved in the directions of the double arrow 89 shown in FIG. 20 by a driving mechanism (not shown) controlled by the computer 30 of the flat knitting machine, even during the movement of the needle beds through a preselected travel so that the bracket 84 can be moved from a position transverse to the needle beds, indicated by dotted line 90 in FIG. 20, to either side into a selected angular position.

The spherical take-down members 78–81, made of a resilient material or with a resilient covering, are in each case arranged beneath a retractible part 91 or 92 of the knitting assembly indicated in FIG. 20. With the bracket 84 in the oblique position illustrated by the dotted line 19 of FIG. 10 the turning direction of the spheres at their point of engagement with the knitwear 23 coincides with the direction of travel of the knitwear 23 indicated by the arrow 93 or the double arrow 89, and no component of force is exerted in the take-down direction indicated by the arrow 94. If in contrast the bracket 84 is brought into the angular position shown in FIG. 20 and the spheres 78–81 apply a take-down component of force to the knitted fabric and always against the new stitches of the fabric 23 just formed at the knitting assembly. Thus by increasing the angular position the component of take-down force exerted on the fabric will be increased or will be diminished by a reducing the angle. During each reversal of the needle bed the changeover bars 87 and 88 will be reversed and the direction of rotation of the spherical take-down members 78, 79, 80, 81 will be changed.

By slightly increasing the peripheral speed of the spherical take-down members relatively to the rate of movement of the needle bed it is possible to arrange that the starting knitted edge of the fabric, which has a natural inclination to be contracted, will be subject to a spreading action during the entrance of the fabric between the spherical pair, so that the selvedge stitches of the fabric held in the needle hooks will be set upright so facilitating the transfer of the stitches and their clearance, and this in addition leads to the fact that the strength of the components of take-down force can be kept smaller with a take-down mechanism in accordance with the invention than is the case with conventional flat knitting machines. This means a more careful handling of the knitted fabric.

FIGS. 21 and 22 show a thread changing device which permits the feeding of a desired thread 69 from a plurality of such threads disposed on the bobbin board 26. The thread changing device has a magazine 95, see FIG. 7, which is displaceably arranged on a rail 96 connected to the needle bed 17. The magazine 95, illustrated in FIGS. 21 and 22, has three double prismatic thread guides 97, 98 and 99 each of which has a thread guide tube 100 connected thereto. In the magazine 95 the three thread guides 97–99 have one prismatic part thereof pushed into a dovetail-shaped bracket 101 which has a pin 102 by which it can be moved in the magazine 95 transversely to the direction of travel of the needle beds 17, 18. FIG. 22 shows the central bracket 101 with its pin 102 in an operative position pushed out of the magazine 95 and without the thread guide 98 associated therewith. In this operative position a thread guide can be moved laterally out of the holder 101 or pushed into it laterally.

The thread guide 98 associated with the central bracket 101 illustrated in its operative position has one of its two prismatic parts inserted into the dovetail guide of a bracket 103 formed at the end of a thread guide arm 104 which at its dovetailed end 105 is adjustably mounted in a guide groove 106 of the knitting assembly 19 between the two take-down cam parts, and this by means of a pin 107. The small thread guide tube 101 of the thread guide 98 is disposed above the comb gap 66 of the flat knitting machine and guides the active threads to the needles 67.1, 67.2 of the two needle beds 17 and 18.

If a change in thread guides is to take place, by a movement of the rear needle bed 18 to the right exceeding that for normal knitting the magazine 95, which is always stationed outside the knitting area, will be propelled past the arm 104. The free prismatic part of the thread guide 98 will then, during this passing movement, be introduced into the central bracket 101, located in its operative position, and consquently pushed out of the bracket 103 of the thread guide arm 104.

The central brack 101 which now re-accommodates the thread guide 98 is now put back into the magazine 95. Before the next needle bed reversal and consequent change in direction of the magazine 95, by electronically controlled operating means the bracket for one of the two other thread guide 97 and 99 is advanced into the operative position and when the magazine 95 passes the thread guide arm 104 is pushed into the bracket 103 thereof.

The magazine 95 is moved, see FIG. 7, invariably to a position which lies outside the knitting area by means of the lugs 108. The magazine 95 only comes into the ambit of the thread guide arm 104 in the event of a change in thread guidance caused by overtravel of the needle bed.

It is important that in all the thread guides 97–99 of the magazine the threads from the upper thread tensioner 110 (FIGS. 6 and 7) is conducted through the thread guide tubes 100 to the knitting assembly and not through a lateral changeover at the end of the machine, as has to in conventional flat knitting machines and which positively leads to a change in thread tension in the two operating directions of the machine carriage.

I claim:

1. A flat knitting machine, particularly an electronically controlled flat knitting machine, with two needle beds, characterised by the fact that the needle bed or beds (17, 18) is or are mounted for movement in the longitudinal direction on the machine frame past at least one stationary knitting assembly (19–22) having cam parts for controlling the needles.

2. A flat knitting machine according to claim 1, characterised by the fact that each needle bed (17, 18) is divided into a number of operating areas (e.g. 17.1, 17.2) corresponding to the number of associated staionary knitting assemblies (19, 22) and these areas are separated by needle-free areas (17.3) the length of which equals at least the length of the stationary assemblies (19–22).

3. A flat knitting machine according to claim 1 characterised by the fact that the moved needle beds (17, 18) are mounted on stationary needle bed supports (15, 16) which are connected, at least at the knitting areas (19–22), by vertical supports (11, 12) with a common foot portion (10) of the machine frame.

4. A flat knitting machine according to claim 3, characterised by the fact that the needle bed supports (15, 16) are arranged on the vertical columns (11, 12) for adjustment transversely to the direction of movement of the needle beds (12, 18) for variation of the comb gap width ($K_1$, $K_2$) of the needle beds (17, 18).

5. A flat knitting machine according to claim 1, characterised by the fact that each of the two needle beds (17, 18) is coupled to an endless driving belt (33, 43) arranged in the associated needle bed support (15, 16) and passing over divert pulleys (36, 37) within a support column (11, 12) downwards to a drive wheel (40), the drive wheels (40, 42) of the driving belts (33, 43) of the two needle beds (17, 18) being secured to a common drive shaft (39) which is arranged at the bottom part of the machine frame, and is coupled to a controlled reversing motor (25).

6. A flat knitting machine according to claim 1, characterised by the fact that at each knitting assembly (19–22) the cam plates with the cam parts, needle selecting elements and all the associated adjusting and control parts are arranged in a housing or frame which can be swung back on the needle bed support (15, 16) to replace parts of the needle bed (17, 18) and can actually be taken away for complete substitution.

7. A flat knitting machine according to claim 1, characterised by the fact that at least one thread (69) is directly fed from a stationary bobbin table (26) through at least one thread guide and thread monitor (110) to each stationary knitting assembly (19–22).

8. A flat knitting machine according to claim 7, characterised by the fact that each stationary knitting assembly (19–22) has associated therewith a thread change device to which a plurality of threads (69) are fed simultaneously and directly from the bobbin table (26) through thread tensioning and monitoring members (110).

9. A flat knitting machine according to claim 1, characterised by the fact that at least one of the needle beds (17, 18) is provided with a racking device.

10. A flat knitting machine according to claim 9, characterised by the fact that to provide for the needle bed racking the divert pulleys (36, 37) for the needle bed driving belts (33, 34) are mounted on a bracket (38, 44) arranged on the machine frame and movable in the direction of travel of the needle bed (17, 18) this bracket being complex through an adjusting spindle (47) with an electrical stepping motor (46).

11. A flat knitting machine according to claim 9, characterised by the fact that each needle bed is connected through a planetary gear (53, 54) with the common reversing motor (25) and the needle bed racking can be performed by operation of this gear (53, 54).

12. A flat knitting machine according to claim 9, characterised by the fact that the racking positions of the needles beds (17, 18) are determined by abutments (48, 52) in the needle-free area (17.3, 18.3) of the needle beds (17, 18).

13. A flat knitting machine according to claim 12, characterised by the fact that the abutments constituted by adjustable buffer slides (48, 52) arranged in a stationary knitting assembly (19–22) and operable when the needle bed (17, 18) passes through.

14. A flat knitting machine according to claim 1, characterised by the fact that it includes at least one slave machine B without any intrinsic driving means or any individual racking device the needle beds (17′, 18′) of this slave machine being rigidly coupled to the primary needle beds (17, 18).

15. A flat knitting machine according to claim 1 with a fabric take-down mechanism, characterised by the fact that each stationary knitting assembly (19–22) has associated therewith only the take-down means (78–81) effective at the stitch forming part.

16. A flat knitting machine according to claim 15, characterised by the fact that the take-down members in each case comprise two opposed rotationary bodies (78–81) arranged beneath a sliding part of the knitting assembly (19, 21), controlled by the travel of the needle beds (17, 18) and rotatable about an axis, the knitted fabric (23, 24) being passed between these bodies.

17. A flat knitting machine according to claim 16, characterised by the fact that the inclination of the rotary axis (82) of the driven rotary bodies, for example spheres (78–81), can be varied from an exact transverse position to either side of the same relatively to the direction of travel of the knitted fabric (23).

18. A flat knitting machine according to claim 16 characterised by the fact that at least the outside of the rotary bodies (78–81) is comprised of a resilient material.

19. A flat knitting machine according to claim 8, comprising double knitting assemblies and a thread guide for each selectively chosen thread, characterised by the fact that a thread guide bracket (104) is provided at each knitting assembly (19–21) in which a thread guide (97–99) selectable from a magazine (95) movable with the needle bed (17, 18) can be inserted, moved between the two clearing cam parts and reinstated.

20. A flat knitting machine according to claim 19, characterised by the fact that the magazine (95) is displaceable on a rail (96) which is connected to the moved needle bed (18) and is mounted for impact by a stationary, driving pin (108) which is controllably operated.

* * * * *